US008804986B2

(12) United States Patent
Donaldson

(10) Patent No.: US 8,804,986 B2
(45) Date of Patent: Aug. 12, 2014

(54) ACOUSTIC TRANSDUCER INCLUDING AIRFOIL FOR GENERATING SOUND

(75) Inventor: Thomas A. Donaldson, London (GB)

(73) Assignee: AliphCom, San Francisco, CA (US)

( * ) Notice: Subject to any disclaimer, the term of this patent is extended or adjusted under 35 U.S.C. 154(b) by 0 days.

(21) Appl. No.: 13/270,976

(22) Filed: Oct. 11, 2011

(65) Prior Publication Data

US 2012/0093345 A1 Apr. 19, 2012

Related U.S. Application Data

(60) Provisional application No. 61/392,813, filed on Oct. 13, 2010.

(51) Int. Cl.
*H04R 1/42* (2006.01)

(52) U.S. Cl.
USPC ..... 381/150; 381/337; 381/165; 181/175

(58) Field of Classification Search
CPC ..... H04R 1/00; H04R 1/42; H04R 1/28; H04R 1/2853; H04R 1/2857; H04R 23/004; H04R 1/2888; H04R 1/2884; H04R 11/00; H04R 11/02; H04R 23/02; H04R 2440/01; H04R 2440/00
USPC ..... 381/150, 337, 345, 386, 395, 165, 160, 381/339; 181/155, 175
See application file for complete search history.

(56) References Cited

U.S. PATENT DOCUMENTS

| | | | | |
|---|---|---|---|---|
| 4,019,375 A | | 4/1977 | Ellis et al. | |
| 4,763,358 A | * | 8/1988 | Danley | 381/165 |
| 4,908,601 A | | 3/1990 | Howze | |
| 5,140,641 A | * | 8/1992 | Danley et al. | 381/339 |
| 5,797,414 A | | 8/1998 | Sirovich et al. | |
| 6,122,386 A | * | 9/2000 | Wiley | 381/160 |
| 2007/0230720 A1 | * | 10/2007 | Stromback | 381/165 |

OTHER PUBLICATIONS

International Search Report and Written Opinion mailed Jan. 30, 2012 in PCT Application No. PCT/US2011/056032 filed Oct. 12, 2011.

Anonymous, "Rotary Woofer", Jul. 6, 2011, [online], [retrieved on Nov. 16, 2011] Retrieved from the Internet <URL: http://en.wikipedia.org/wiki/Rotary_woofer>.

Anonymous, "TRW-17:The Worlds First True Subwoofer", no date given, [online], [retrieved on Nov. 16, 2011] Retrieved from the Internet <URL: http://www.rotarywoofer.com>.

* cited by examiner

*Primary Examiner* — Brian Ensey
*Assistant Examiner* — Sabrina Diaz
(74) *Attorney, Agent, or Firm* — Kokka & Backus, PC

(57) ABSTRACT

Systems, apparatus, devices, and methods for converting electrical signals into sound using an acoustic transducer. The inventive acoustic transducer utilizes the motion of an airfoil shaped element to generate a sound wave, with the airfoil element being driven in response to an electrical signal input to a suitable driving element. In some embodiments, the airfoil element or elements act to mechanically couple the motion of an armature attached to the driver to the surrounding air, producing sound waves in a more efficient manner than typical acoustic transducer devices. Embodiments of the invention may be used in the design of loudspeakers, earpieces, headphones, and other devices for which a high efficiency transducer is desired.

20 Claims, 6 Drawing Sheets

501

ACOUSTIC TRANSDUCER INCLUDING AIRFOIL FOR GENERATING SOUND

CROSS-REFERENCE TO RELATED APPLICATION

This application claims priority from U.S. Provisional Patent Application No. 61/392,813, filed Oct. 13, 2010, and entitled "Acoustic Transducer Including Airfoil for Generating Sound," the contents of which are hereby incorporated in its entirety by reference for all purposes.

BACKGROUND

Embodiments of the invention are directed to systems, apparatuses, and devices used to convert an input electrical signal into sound, and more specifically, to an electro-acoustic transducer that may be used in an earpiece, headphone, loudspeaker or similar device. Embodiments of the invention utilize a driver that causes the motion of one or more airfoil-shaped elements in order to generate sound in a more efficient manner than conventional devices.

In many devices and systems it is desirable to generate sound in response to an input signal. This process is commonly performed using an electro-acoustic transducer which functions to convert an input electrical signal into acoustic or sound waves which are then perceived by a listener. Some form of such a transducer may be found in earpieces, headphones, and loudspeakers, to name a few examples. A variety of electro-acoustic transducers are known, with their operation typically being based on controlling the motion of an element in response to an input signal, where the motion of the element creates an acoustic wave. The acoustic wave created is a longitudinal wave that is generated by a local pressure gradient that results from the motion of the element. For example, a common electro-acoustic transducer such as a loudspeaker operates by moving a diaphragm (which is typically cone-shaped) approximately longitudinally in order to generate longitudinal sound waves propagating in the same direction as the movement of the diaphragm or cone. The diaphragm or cone may be driven (i.e., caused to move) by a solenoid or other form of electromagnetic driver, by a piezoelectric driver, etc. An electrical signal is input to the driver to produce the motion of the diaphragm, with the signal typically produced by a signal source (such as an amplifier, tuner, MP3 decoder, etc.). As the signal changes, the motion of the diaphragm changes in response, with the diaphragm motion generating the desired acoustic waves which are perceived as sounds by a listener.

Although such electro-acoustic transduction devices and methods of operation perform the desired function, a problem common to many such transduction devices is their relatively low efficiency with regards to the conversion of electrical energy into sound energy (for example, typically only a small percentage of the input electrical energy is converted into sound). This inefficiency leads to a number of disadvantages for many existing speaker designs, primarily because they must use more electrical power to generate a given sound level. For example, this inherent inefficiency can impact the size of a power source that is needed to obtain a desired level of operation (such as a battery for a portable loudspeaker), as well as the cost of the electrical energy required for operation, and its storage or transmission equipment. This inefficiency also means that the driver mechanism for a transducer must be relatively stronger, typically leading to a larger, more expensive, and heavier system as a whole. In general, many common speaker designs tend to be more expensive, have greater power consumption, and be larger and heavier than would be optimal, with these disadvantages being at least partially due to the inefficiency of the electrical-to-acoustic conversion process.

As recognized by the inventor, a key contributor to the inefficiency of the electrical to acoustic energy conversion process in many transducers is the relative (in)efficiency of the conversion of mechanical energy of the moving part of a transducer (e.g., the cone or the diaphragm) into sound waves. This is at least partially the result of a relatively poor match between the acoustic impedance of the diaphragm (or other moving parts) and the surrounding air, as the optimum efficiency of a transducer is expected to occur when the impedance of such elements are substantially equal. In the case of a typical loudspeaker, air (in common with many gases) has a relatively low acoustic impedance, whereas a diaphragm or cone (being substantially solid) has a significantly higher acoustic impedance.

While such an inefficiency is a problem for many uses of electro-acoustic transducers, it can be a particularly significant problem in the production of lower sound frequencies (for example bass frequencies). At such frequencies, the loudspeaker or transducer is typically small compared to the wavelength of sound being produced, often resulting in poor reproduction of those frequencies. Using a physically larger speaker may provide a solution, but at the cost of increased weight and power consumption, which are both undesirable for some types of systems (such as portable sound reproduction systems).

As a result of these problems, and as recognized by the inventor of the invention described herein, an electro-acoustic transducer that provided an increased loudspeaker efficiency, particularly with regards to the efficiency of the conversion of the mechanical energy of a moving part of the transducer into sound energy, would be desirable. Such a design would potentially have the benefits of reducing the cost, size, power consumption and weight of loudspeakers and other systems employing acoustic transducers.

What is desired is an electro-acoustic transducer that is capable of more efficiently converting electrical energy into acoustic energy than presently available designs. Embodiments of the invention address these problems and other problems individually and collectively.

SUMMARY

Embodiments of the invention are directed to systems, apparatuses, devices, and methods for converting electrical signals into sound through the operation of an electro-acoustic transducer. In some embodiments, the inventive transducer utilizes the motion of one or more airfoil-shaped elements to generate a sound wave, with the airfoil element(s) being driven in response to an electrical signal input to a suitable driving element. In some embodiments, the airfoil element or elements function to mechanically couple the motion of an armature attached to the driving element to the surrounding air, producing sound waves in a more efficient manner than typical electro-acoustic transducer devices. Embodiments of the invention may be used in the design of loudspeakers, earpieces, headphones, and other devices for which a relatively high efficiency acoustic transducer is desired.

In other embodiments, one or more airfoil-shaped element(s) may be placed in the flow of a generated (and typically continuous, although in some embodiments discontinuous) airstream. The angle of attack (i.e., the angle between a chord of the airfoil-shaped elements and the direction of the incoming airstream) may be varied to generate an acoustic wave that is perceived as sound by a listener, where the acoustic wave results from variations in the "lift" generated by the interaction of the airstream and the airfoil-shaped element(s) (i.e. by increasing or decreasing the pressure generated by the airfoil elements). In some embodiments, the velocity of the generated airstream may be varied to produce a change in volume of the generated acoustic signal. In some embodiments, the airstream may be generated or conditioned by the action of another element, such as a static airfoil that is used to produce an airstream having properties more conducive to generating the desired acoustic wave (such as an increased density or better conditioned airflow). In such embodiments, a substantially static airfoil may be used to efficiently generate a relatively high density, high velocity continuous airflow over a movable airfoil, with the angle of attack of the movable airfoil being varied in response to an input electrical signal to generate an acoustic wave.

Embodiments of the invention provide an improved and more efficient transduction/conversion of mechanical energy into sound energy, and thereby an improved conversion of an input electrical signal into sound waves. Embodiments of the invention also provide a means of improving the operation of bass speakers, for example by allowing them to be smaller and to operate using less power than many current designs, thereby improving their portability and the amount they may be used without recharging their power source (such as a battery).

In one embodiment, the invention is directed to a transducer operative to convert an input signal into an output acoustic wave, where the transducer includes a source of airflow having an outlet, an airfoil-shaped element positioned relative to the outlet so that air exiting the outlet flows predominantly along the surface of the airfoil-shaped element, and a driver operative to rotate the airfoil-shaped element in response to the input signal, thereby causing an angle of attack between the airfoil-shaped element and the air exiting the outlet to vary in response to the input signal.

In another embodiment, the invention is directed to a system for producing an acoustic wave in response to an input signal, where the system includes a source of the input signal, a source of airflow having an outlet, an airfoil-shaped element positioned relative to the outlet so that air exiting the outlet flows predominantly along the surface of the airfoil-shaped element, and a driver operative to rotate the airfoil-shaped element in response to the input signal, thereby causing an angle of attack between the airfoil-shaped element and the air exiting the outlet to vary in response to the input signal.

In yet another embodiment, the invention is directed to a transducer operative to convert an input signal into an output acoustic wave, where the transducer includes a driver, an armature element coupled to the driver, the armature undergoing motion in response to the input signal being input to the driver, and an airfoil-shaped element coupled to the armature element and operative to move in response to the motion of the armature element, wherein the airfoil-shaped element is coupled to the armature element in a manner so as to generate a longitudinal sound wave as the armature element undergoes motion.

Other objects and advantages of the present invention will be apparent to one of ordinary skill in the art upon review of the detailed description of the present invention and the included figures.

DETAILED DESCRIPTION

Figure 1:
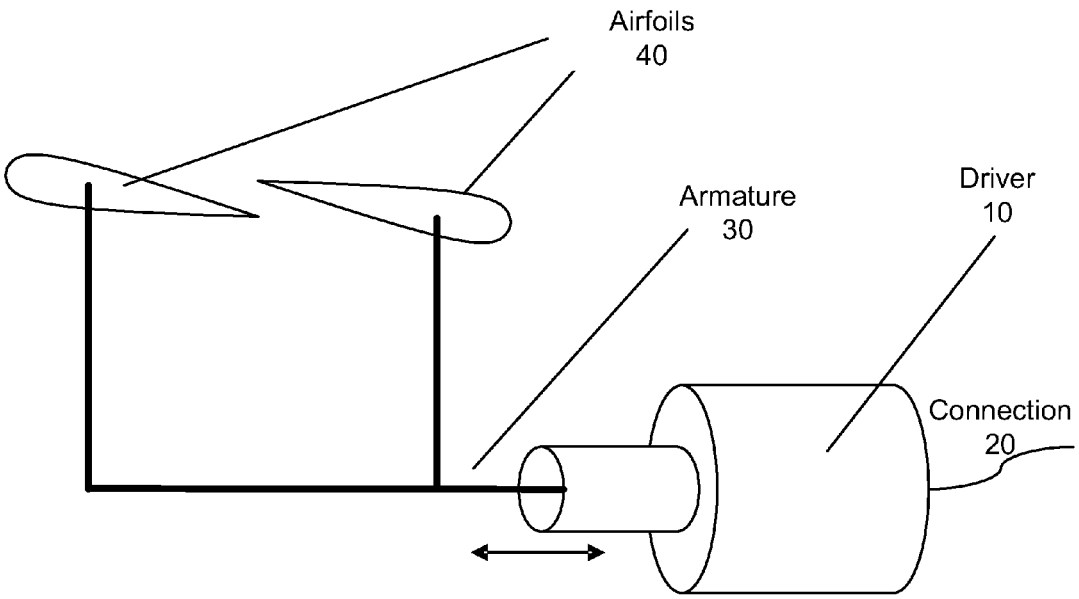
FIG. 1 is a diagram illustrating the primary functional elements of an example embodiment of the inventive acoustic transducer.

Embodiments of the invention are directed to systems, apparatus, devices, and methods for converting electrical signals into sound using an electro-acoustic transducer, such as may be part of a loudspeaker or earpiece. In some embodiments, the inventive acoustic transducer relies on the motion of an airfoil-shaped element placed within an airflow to generate a sound wave, with the motion of the airfoil-shaped element being driven in response to an electrical signal input to a suitable driving element. In some embodiments, the airfoil-shaped element (or elements) functions to mechanically couple the motion of a voice coil (driven by an audio amplifier, for example) to the surrounding air, thereby producing sound waves in a more efficient manner than typical acoustic transducer devices. Embodiments of the invention may be used in the design of loudspeakers, earpieces, headphones, and other devices for which a high efficiency transducer is desired to assist in generating sound in response to an electrical signal input to the transducer.

Although the primary embodiments of the invention that will be described generate sound by driving the motion of an airfoil-shaped element (or elements) in response to an input signal, another possible implementation of an acoustic transducer produces sound by modulating the airflow impinging on an airfoil-shaped element in response to an input signal. In one example of this design, air is caused to flow between two plates, where one of the plates is moveable in response to the input signal. As the distance between the plates is varied, the airflow velocity will increase/decrease due to the Venturi/Bernoulli effect, and hence the sound pressure across the airfoil-shaped element will change. The airfoil element is configured to be capable of movement in response to the changes in sound pressure (e.g., being mounted on a piston or other movable element), with that movement contributing to the production of sound.

Prior to discussing the operation of one or more embodiments of the invention in greater detail, it may be helpful to describe the principle of operation of an airfoil as it pertains to the invention. In particular, an airfoil's motion relative to the air approximately parallel to its chord may be used to create air density/pressure gradients perpendicular to the chord. Such pressure gradients are typically proportional to the angle of attack (i.e., the angle the chord makes with the airflow) up to the "stall point", which typically occurs when the angle of attack is between 10 and 15 degrees. These gradients may serve as the source of a longitudinal wave which propagates through the air, creating a perceptible sound. As recognized by the inventor, the mechanical motion to air-pressure conversion efficiency (i.e., the coupling between the airfoil motion and the resulting local pressure variation that creates a sound wave) of an airfoil is substantially better than that for many other devices or systems that may be used for a similar purpose. For example, cone transducers used in typical loudspeakers have a conversion efficiency of between 5% and 10%, or even lower for lower frequencies. In contrast, an airfoil typically has a conversion efficiency in excess of 90% (and potentially closer to 95%) as derived from its lift-to-drag ratio.

Note that it is the relative motion between an airfoil element and an airstream or the surrounding air that generates the "lift" and hence produces a longitudinal wave. As noted, this may be accomplished by moving an airfoil in the air and varying that motion in response to an input signal, or by causing a stream of air to flow into the airfoil (and if desired, varying the characteristics of that stream). Embodiments of the invention that utilize one or both of these mechanisms to generate a sound wave may be constructed and used as part of a loudspeaker, earpiece, headphone, or similar device.

As will be described in greater detail, according to one embodiment, the invention is directed to an electro-acoustic transducer, where the transducer includes:

- An electromechanical driver operative to move laterally or radially in response to an input electrical signal; and
- One or more airfoil-shaped element(s) coupled to the driver in a manner so as to move in a direction that generates lift as the driver moves laterally or radially through part of its motion, with such lift operating to generate a sound wave as the driver undergoes motion.

According to another embodiment, the invention is directed to a method of generating an acoustic (sound) wave by vibrating or otherwise causing the lateral or radial motion of an airfoil-shaped element or elements in response to an electrical signal that is input to a driver, with the driver and airfoil elements operating as a transducer that converts the input signal into a sound wave or waves.

According to another embodiment, the invention is directed to an electro-acoustic transducer, where the transducer includes:

- An airflow generator operative to generate a substantially constant (or in some cases varying) airstream;
- A plurality of airfoil-shaped elements placed in the airstream; and
- An element operative to vary the angle of attack of the airfoil-shaped elements relative to the airstream in response to an input electrical signal, thereby causing the invention to function as a transducer to convert the input electrical signal into sound.

According to yet another embodiment, the invention comprises a method of generating acoustic (sound) waves by:

- Generating a substantially constant airstream;
- Rotating an airfoil-shaped element in the airstream; and
- Varying the angle of attack of the airfoil-shaped element relative to the airstream in response to an input signal, thereby generating acoustic pressure waves.

One or more example embodiment(s) of the invention will now be described with reference to the included figures. It is understood that other embodiments of the invention are possible and operate in accordance with the underlying concepts to be described, and are therefore considered to be enabled by the disclosure provided by this application.

Specifically, embodiments of the invention include those in which one or more airfoil-shaped elements are caused to move in the surrounding air in response to an input signal, and those in which one or more airfoil-shaped elements are positioned in the flow of a stream of air, with the angle of attack of the airfoil elements being varied in response to an input signal. In either of these two broad types of embodiments (which may be used in combination) the relative motion between the airfoil element(s) and the surrounding air or airstream results in a pressure differential between two surfaces of the airfoil-shaped element(s). This produces a "lift" or force that causes a pressure variation in the surrounding air and generates a longitudinal pressure wave. By varying the movement of the airfoil element(s) and/or the characteristics of the air stream, a longitudinal wave of varying frequency may be generated, with the longitudinal wave being perceived as sound by a listener.

FIG. 1 is a block diagram illustrating the primary functional elements of an example embodiment of the present invention. In this embodiment, an airfoil-shaped element (or elements) is caused to move in a controllable manner in response to an input signal. The motion of the airfoil element (or elements) is responsible for generating a longitudinal wave that propagates through the surrounding air. In accordance with this embodiment, a driver 10 includes a connection 20 to a source of an electrical signal (such as an amplifier or other signal output device, and that is not shown in the figure). The electrical signal is to be converted into an acoustic wave or waves (thereby generating a perceptible sound). In this example embodiment, driver 10 is connected, attached or otherwise coupled to (or may include) an armature 30 which may be driven back and forth laterally (i.e., in the direction shown by the arrow) in response to the input electrical signal.

Armature 30 of driver 10 is connected, attached or otherwise coupled (by appropriate attachment or connection means) to a plurality of airfoil-shaped elements 40. In one embodiment, each airfoil-shaped element 40 is mounted relative to armature 30 in a manner so that the airfoil element moves through the air in a direction that generates lift as armature 30 moves through at least a portion of its overall motion or cycle. Note that as an electrical signal corresponding to a desired sound to be generated is input to driver 10, driver 10 will drive armature 30 in a mechanical motion in the direction of the arrows shown in the figure. This in turn will drive airfoil shaped elements 40 through the air. The motion of airfoil elements 40 operates to create a density/pressure variation in the air, giving rise to a longitudinal traveling wave, with the propagating wave generating sound that is perceived by a listener. Note that in operation, airflow over the airfoil generates a pressure differential across the airfoil. This is due to the airflow across the longer path (e.g., the upper camber) moving faster and hence being at a lower pressure than airflow across the shorter path (e.g., the lower camber). In an unconstrained airfoil (e.g., an airplane wing), this pressure differential causes a force to act on the airfoil, creating lift. However, in the case of a constrained airfoil (i.e., one that is not permitted to move or undergo full movement in response to the lift force), there is a reaction force to the lift force because of the constraint. The reaction force acts on the air to generate a pressure wave.

Note that a wide range of suitable drivers or driving mechanisms are known and may be used in implementing embodiments of the invention, including for example, solenoids, piezo-mechanical transducers, and magneto-strictive transducers, with each being available in a variety of shapes and sizes. For this reason, the design of the driver mechanism depicted in FIG. 1 has not been described in further detail. One of ordinary skill in the art is understood to be capable of selecting a suitable driving mechanism and adapting its operation to embodiments of the invention.

While many airfoils have a characteristic shape (i.e., that of a typical airplane wing), it should be understood that the shape of an airfoil that is suitable for use in implementing an embodiment of the invention may vary from this characteristic shape, as may the material and construction details (such as the cross-section or design of supporting baffles, etc.) of such an airfoil. In general (although it is not required), it is advantageous to utilize a symmetric airfoil (i.e., one whose upper camber is identically shaped to its lower camber) in order to ensure that both polarities of the generated pressure waves are substantially equal.

Airfoils suitable for use in some embodiments of the invention may undergo relatively rapid changes in their angle of attack relative to a surrounding medium, and thereby be subjected to significant torsion forces and vibrations that may not arise in more traditional uses of airfoils. To prevent failure of the transducer, these operating conditions may require relatively stiffer airfoil elements. Further, the potentially rapid motion of the airfoil elements also consumes energy, so it is desirable to minimize the weight of the airfoil elements to reduce energy consumption. As a result, use of relatively stiff, lightweight materials (e.g., aluminum, ABS) and certain construction techniques (e.g., hollow, honeycomb, etc.) may be desirable to provide optimal performance.

In many applications, it is desirable that the airfoil be physically small compared to the shortest wavelength (i.e. the wavelength of the highest frequency) that it is required to generate. This is desirable to avoid pressure variations over the airfoil camber from reducing the airfoil lift effects. As an example, airfoils used for sub-woofers are preferably under 5 cm long, while airfoils used for mid-range speakers are preferably under 1 cm long. Further, in order to provide a sufficient degree of stiffness for such a size of airfoil, it is desirable that the airfoil have a thickness of approximately 15 to 20% of the chord length.

In general, one of the principles of operation of some embodiments of the inventive transducer is that if a driver operates to cause movement of an element (or elements) in such a way as to generate a longitudinally propagating wave, then a suitable input signal can be applied to the driver to produce a desired acoustic wave as an output by altering the motion of the element (or elements) in response to the input signal. Further, if the element (or elements) that undergo motion in response to the input signal are shaped so as to relatively efficiently couple their motion to the surrounding medium (e.g., air), then the transducer will operate more efficiently to generate an acoustic or sound wave from the input signal. And, as recognized by the inventor, an airfoil shape may provide a relatively high-efficient design for coupling the mechanical motion of the airfoil element to the surrounding air, resulting in the conversion of an input signal to an output sound wave in a more efficient manner than many currently available transducer designs.

In some embodiments, the "lift" generated by an airfoil moving relative to a surrounding medium (e.g., air) is used to create a pressure gradient in the surrounding air that is responsible for generating a longitudinal wave. Modulation of the movement of the airfoil element in response to an input signal is used to produce an acoustic or sound wave with desired characteristics (frequency). Note that although the moving or movable elements have been described as being airfoils, airfoil-shaped elements, or a similar term, other shaped elements may also be used in implementing embodiments of the invention. Such elements are understood to operate in the same or a similar manner as an airfoil, that is to generate a longitudinal wave as a result of motion of the elements in a surrounding medium that is caused by a driving element (e.g., by producing a pressure differential between two parts of the driven element as the element moves through the air, with the resulting "lift" force being used to generate a longitudinal wave).

Further, as will be described, in some embodiments a relative motion between an airfoil-shaped element or elements and a surrounding medium is produced by positioning the airfoil-shaped element or elements in an airstream, with the relative angle of attack between the airstream and the airfoil element(s) being varied in response to an input signal. As a further variation, a static airfoil may be used to provide a consistent stream of air that is directed over a movable airfoil. The static airfoil may function to increase the air density over the movable airfoil, thereby increasing the efficiency of the transducer.

Note that there are multiple shapes, materials, cross-sections and construction details for the airfoil element(s) that may be used in implementing embodiments of the present invention. In general, however, materials and construction methods that produce lightweight and rigid airfoils are preferred, as they are expected to perform more efficiently. For example, an airfoil element may be made of a material such as ABS or aluminum, which are noted for their desirable strength to weight ratio. The airfoil element may be of a hollow extruded shape, an extruded honeycomb, or other suitable shape, etc.

In some embodiments, the angle of attack of an airfoil element relative to the surrounding air or airflow may be varied at the frequency at which sound is to be generated. The angle of attack may be varied by altering the orientation of an airfoil relative to an airstream, or by changing the airstream velocity relative to an airfoil (assuming a non-zero angle of attack). In some cases (although it is not required), it may be preferable to rotate an airfoil relative to an airstream, as this can be done more rapidly and therefore at a higher frequency than moving the airfoil laterally or changing the airstream velocity.

Figure 2:
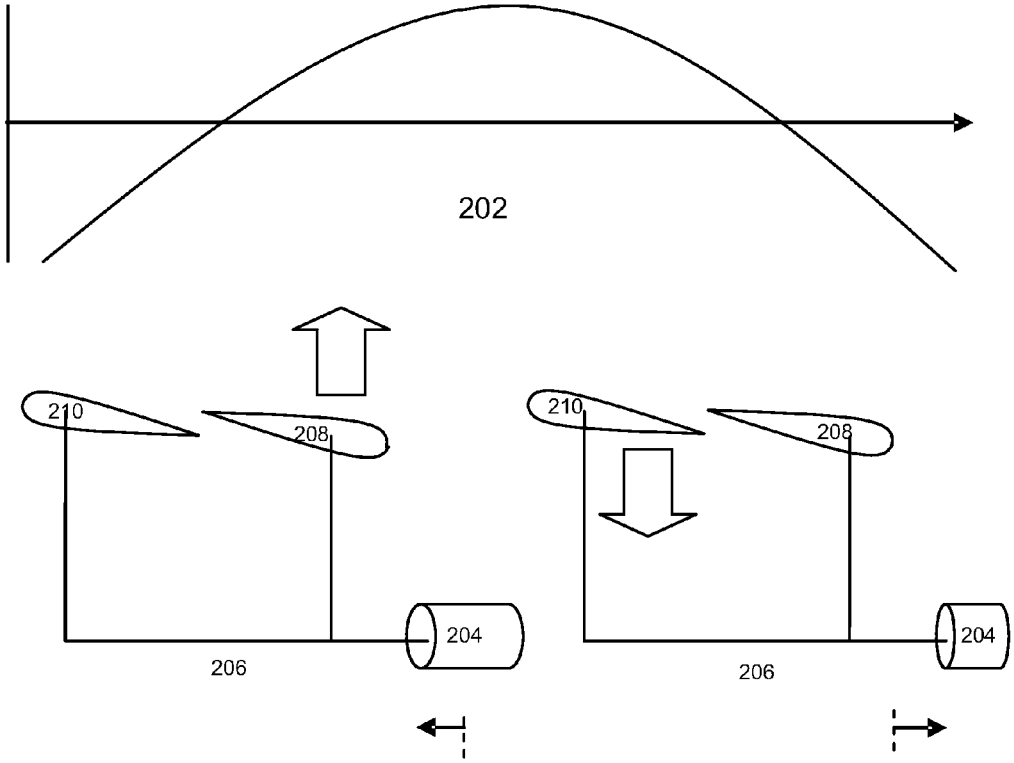
FIG. 2 is a diagram illustrating an example electrical signal (such as a portion of a sine wave) that may be used as an input to drive the motion of an airfoil element in an implementation of an embodiment of the inventive acoustic transducer.

FIG. 2 is a diagram illustrating an example electrical signal 202 (such as a portion of a sine wave) that may be used as an input to drive the motion of an airfoil element in an implementation of an embodiment of the present invention. The electrical signal or waveform 202 shown in the figure is for purposes of explaining certain aspects of the operation of the inventive transducer and is not intended to represent or otherwise limit the form of a signal that may be used as an input. Note that the electrical signal corresponding to a typical input and which would be used to generate a desired output sound wave would typically extend for a longer period than the example shown, and would typically consist of multiple full cycles of a single sinusoid (and possibly more complex waveforms). Note also that an electrical signal or waveform that describes a desired acoustic output can be considered to be the sum of multiple, individually weighted sinusoid signals, and therefore that this example can be generalized to electrical signals and sound waves of greater complexity. For example, a spectral decomposition method such as a Fourier transform (or inverse transform) may be used to convert an electrical signal corresponding to a sound wave into a sum of properly weighted sine waves, and vice-versa, to convert a set of properly weighted sine waves into an electrical signal corresponding to a desired sound wave.

In the embodiment shown, as an electrical input signal is applied to the driver (identified as element 204 in the figure), the driver's armature (identified as element 206 in the figure) will be caused to move forward and back in an approximately lateral motion, with the distance moved being proportional to the electrical current (or equivalently to the electrical voltage)

applied to the driver as a result of the input signal (not shown). In some cases, the driver may operate in a manner such that the armature motion is not proportional to the applied input voltage or current but instead is related to the input by a known response function. Alternatively, an armature may be caused to rotate back and forth in response to an electrical signal applied to a voice coil/driver, and thereby change the angle of attack of the airfoil relative to its surrounding environment.

As the armature moves back and forth laterally in response to the electrical signal being input to the driver, the airfoil(s) will generate an air pressure wave, with such a wave being an acoustic/sound wave that propagates longitudinally in the vertical direction. Thus, the airfoil elements, in being moved back and forth, function as mechanical-acoustic transducers by converting mechanical motion into an acoustic wave, and the device depicted in the figure operates as an electro-acoustic transducer (e.g., a loudspeaker).

The lift generated by motion of an airfoil arises from a pressure differential between its top and bottom surfaces, and is proportional to the square of its velocity in a direction parallel to its chord. Therefore, as the driver armature accelerates and decelerates in response to an applied sinusoidal electrical field, the resulting acoustic/sound wave that is produced will typically not be sinusoidal but will instead be closer to the square of a sinusoid. As a result, the generated sound wave may contain harmonic information not in the original input signal, which will be perceived by a listener as distortion. To reduce or eliminate this distortion, in some embodiments it may be preferable for the input electrical signal to be pre-processed (e.g., by taking the square root of the electrical signal) so that the generated acoustic wave is less (or not) distorted. Such pre-processing may be performed by analog electronics, by a digital signal processing integrated circuit, by software executed by a suitably programmed processor, or by another suitable device or method.

Figure 3:
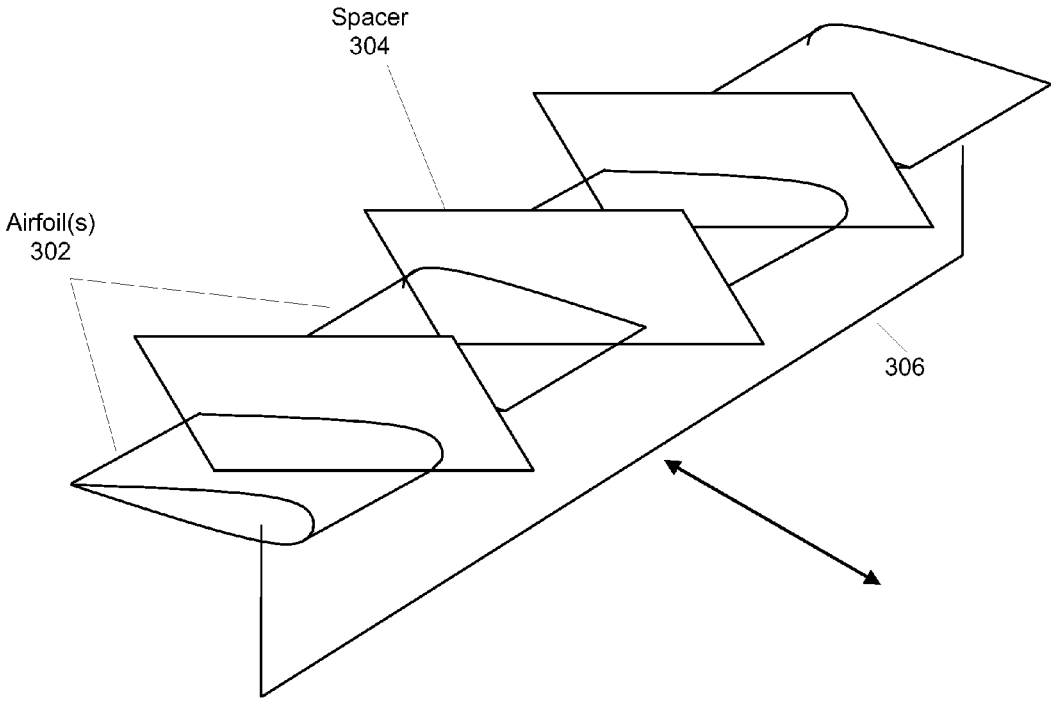
FIG. 3 illustrates an arrangement of airfoil elements and spacer elements that may be used to implement an embodiment of the inventive acoustic transducer.

FIG. 3 illustrates an arrangement of airfoil-shaped elements and spacer elements that may be used to implement an embodiment of the present invention. In this embodiment, a number of airfoil-shaped elements 302 are arranged in a straight line perpendicular to the airfoil cross-section, alternating in direction, with for example, the first being upright and to the left, and the second upside down and to the right (i.e. rotated 180 degrees around the axis perpendicular to the cross section), and so on. Such an arrangement may be mounted on an armature 306 coupled to a driver by means of mounting points at either end. Note that such an arrangement will move laterally in accordance with the movement of the armature, with the arrangement generating lift in alternating directions. However, because the airfoils are in line, there are fewer obstacles to smooth airflow and hence an increased efficiency may be obtained.

A spacer 304 may be provided between each pair of alternately oriented airfoils 302, with such a spacer being in a plane parallel with the cross section of the airfoils and placed so as to reduce airflow from one airfoil reaching the one next to it. Such placement will act to prevent the airflow of an airfoil that is not oriented for optimal lift at a particular moment or armature position from reducing the lift of a neighboring airfoil that is more optimally oriented for the current motion or position.

As noted, in some embodiments, it is preferable that airfoil shaped elements 302 be designed to be relatively lightweight. This is desirable because the energy required to accelerate and decelerate airfoil elements 302 during each cycle of the armature's motion is a key contributor to the overall energy required to generate the resulting sound wave, while it is the airfoil elements' velocity that contributes to generating the sound waves. Airfoil elements 302 should preferably be designed to be relatively rigid, as flexing of the airfoils under the pressure of the air results in less air being moved, and hence to a lower overall efficiency. A possible design for a lightweight, relatively-rigid airfoil element is one having a honeycomb structure inside the airfoil elements to provide a balance of rigidity and lighter weight. The airfoil elements may be made out of rigid plastic, such as ABS, aluminum, titanium, or other metals or metallic alloys that combine strength with relatively low density.

Figure 4:
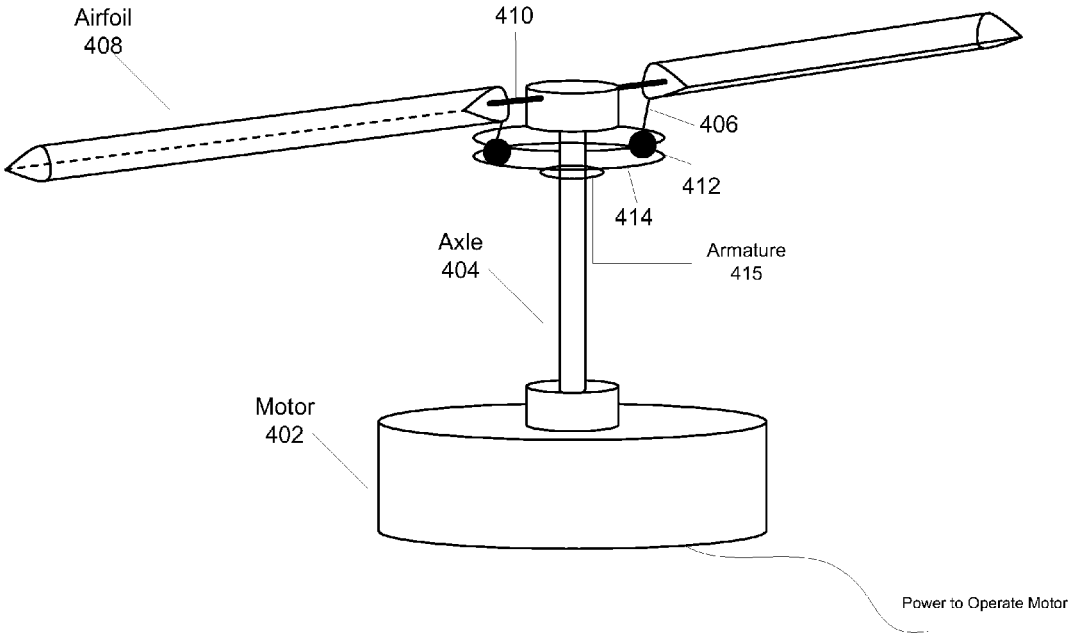
FIG. 4 illustrates the primary functional elements of another example embodiment of the inventive acoustic transducer.

FIG. 4 illustrates the primary functional elements of another example embodiment of the present invention. In this embodiment, a rotary motor 402 is used; it may be of fixed or variable speed, and if fixed be controlled by a suitable on/off switch or element. Motor 402 is coupled to an axle 404 that rotates as the motor shaft rotates. Attached to axle 404 are one or more variable-angle of attack airfoil connectors 406, operative to alter the angle of attack of an airfoil or airfoil-shaped element 408 in response to an applied electrical signal (not shown). Airfoil element(s) 408 are attached or oriented in such a way that as axle 404 rotates, airfoil element(s) 408 move through the air in a manner to produce lift, that is the motion is broadly parallel to the airfoil chord.

As axle 404 rotates, airfoil connectors 406 rotate with it, and therefore the airfoils 408 themselves rotate. Depending on the angle of attack of airfoil elements 408 relative to the air, as the airfoil elements move they may generate lift, with such lift being in a direction generally parallel to axle 404. The direction of the lift force will be up or down depending on the angle of attack of the airfoil elements. Now consider application of the sinusoidal electrical input signal discussed above with reference to FIG. 2 to the variable angle-of-attack airfoil connectors of FIG. 4. As the electrical signal varies sinusoidally, the angle of attack of the airfoil elements relative to the surrounding air or environment will also vary. The lift of an airfoil-shaped element varies approximately in proportion to the angle of attack, up to an angle of attack of approximately 10 degrees, with some dependence upon the airfoil design. As the angle of attack varies sinusoidally (or approximately in that fashion) in response to the input electrical signal, the lift generated by movement of the airfoil elements will vary sinusoidally (or approximately so). This will generate a longitudinal wave (i.e., a sound wave) propagating parallel to the axis of the axle.

The magnitude (amplitude) of the generated wave will be a function of the rotational velocity of the airfoil elements, that is the rotation speed of the motor. The faster the motor rotates, the greater the magnitude (or equivalently the loudness) of the sound wave produced. Thus a "volume" control for the output produced by this exemplary transducer may be implemented by varying the rotation speed of the motor. Note that a wide range of motors are suitable for implementing an embodiment of the invention, including but not limited to, brushless DC motors, AC motors, piezo-electric motors, etc.

The airfoils or airfoil shaped elements 408 shown in FIG. 4 may be constructed from a wide range of materials, but preferably are constructed from materials that are both relatively rigid and lightweight. Rigidity increases the efficiency of the airfoil, while reducing the weight reduces the angular momentum, and hence the energy required to drive (i.e., rotate) the airfoils.

FIG. 4 also illustrates an example embodiment of the variable angle-of attack airfoil connectors 406. In the example embodiment shown, airfoil element 408 connects to axle 404 by means of a pin 410 able to rotate through a socket, with the center line of the pin lying on the center line of the airfoil. A ball 412 is attached to the edge of the airfoil off the center line, by means of an appropriate pin, with the pin directed perpendicular to the plane of the airfoil, and the ball being constrained to run in a circular track 414 around the axle, and centered on the axle. The track is constrained to be able to move up and down (i.e., in a direction parallel to the axle), but not off axle. This may be accomplished for example, by means of a collar attached to the axle. Track 414 is attached to the armature 415 of a linear driver (not shown), which is driven by an input electrical signal that is to be converted by operation of the inventive transducer into an acoustic/sound wave. Such a driver may be of the type discussed with reference to FIG. 1 or 2, or may be of another suitable type. The embodiment shown in FIG. 4 operates such that as the linear driver extends and retracts an armature in response to an input electrical signal, the track moves up and down the axle.

As the electrical input signal varies (for example sinusoidally), the armature of the driver will move in and out (in a sinusoidal fashion in this example). As it does so, track 414 will move up and down along axle 404. Due to the pin constraining the airfoil's center line (and causing it to remain in position), the movement of the track will cause ball 412 to move up and down, and in doing so cause airfoil 408 to rotate about its center line. The rotation of the airfoil about the center line causes a change in the angle of attack of the airfoil relative to the surrounding air (or other medium in which it is operating). Therefore, in response to the movement of the armature of the driver (caused by the fluctuation in the input signal), the angle of attack of an airfoil-shaped element is caused to vary. Thus, the apparatus shown in FIG. 4 operates as a transducer of electrical energy into acoustic energy and may be used (with other elements if needed) to perform the function of a loudspeaker.

While the embodiments of the invention previously described generally operate by moving one or more airfoil-shaped elements in the surrounding medium (typically air) in response to an input signal, in other embodiments a flow of air over one or more airfoil-shaped elements may be modulated to produce an acoustic wave. In other embodiments, a combination of a static airfoil and one or more movable airfoils may be used to provide a conditioned airstream that flows over the movable airfoil elements to efficiently produce an acoustic wave in response to an input signal.

In such an embodiment, the static airfoil provides an effective way to condition the airflow impinging on the moveable airfoil(s) for a number of reasons. Because the static airfoil functions as a Coanda surface (i.e., a surface that airflow follows in accordance with the Coanda effect), it acts to keep the airflow flowing in a consistent direction as it impinges on the moveable airfoil(s). This ensures that the angle of attack of the moveable airfoil(s) is directly dependent on the position of the moveable airfoil(s). The Coanda surface also functions to reduce turbulence, providing more reliable performance of the transducer. In addition, the static airfoil acts to accelerate the airflow, and hence the airflow generator (to be described with reference to FIG. 5) does not need to produce air that is moving as fast. As the air flows over the static airfoil, its density and hence its acoustic impedance increases, resulting in improved efficiency. Further, because the airflow exits through the static airfoil (to be described with reference to FIG. 5), as a result of a process known as entrainment, the volume of air flowing over the movable airfoil is greater than the volume of air being produced by the airflow generator, and hence the overall system is made more efficient.

Figure 5:
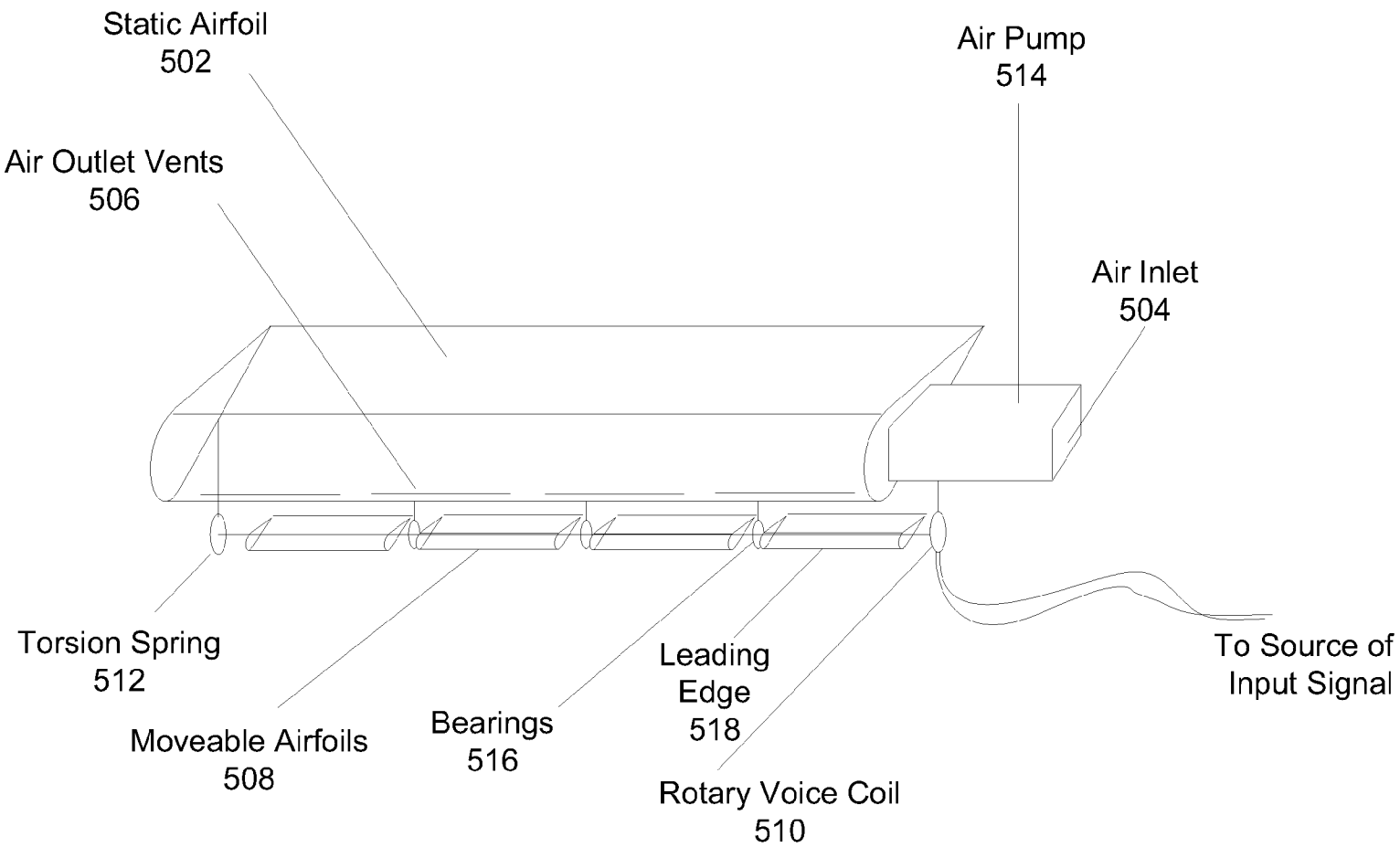
FIG. 5 is a diagram illustrating the primary functional elements of an embodiment of the inventive acoustic transducer in which a static airfoil is used to provide an airstream that is directed onto one or more movable airfoil elements.

FIG. 5 is a diagram illustrating the primary functional elements of an embodiment of the inventive acoustic transducer in which a static airfoil is used to provide an airstream that is directed onto one or more movable airfoil elements. As shown in the figure, transducer 501 includes a static airfoil 502 that is provided with an air inlet 504 and one or more air outlet vents 506, thereby permitting air obtained from inlet 504 to flow within static airfoil 502 and exit via vents 506. Transducer 501 also includes one or more movable airfoil-shaped elements 508. Movable airfoil-shaped elements 508 may be mounted via appropriate bearings 516 to airfoil 502 or to another part of the transducer assembly. Movable elements 508 may be caused to rotate by action of rotary voice coil 510, with such motion countered by a suitable torsion spring 512 or similarly functioning element. An air pump or airflow generator 514 is used to generate an airflow into static airfoil 502 from air obtained via air inlet 504.

The function and operation of the transducer design shown in FIG. 5 will now be discussed in greater detail. In some embodiments, air pump or airflow generator 514 is used to produce a substantially constant airflow into airfoil 501 and through vents 506 onto the surface of one camber of movable airfoil elements 508 from the leading edge to the trailing edge of those elements. Note that airfoil-shaped elements 508 are oriented relative to the airflow leaving vents 506 so that the airflow flows predominantly along the surface(s) of each airfoil-shaped element instead of across them. When the moveable airfoil is in its neutral position, the airflow from the static airfoil should be substantially parallel to the moveable airfoil's chord—that is the angle of attack of the moveable airfoil relative to the airflow from the vent and over the static airfoil should be approximately zero. Because the airflow is moving faster over one camber of each airfoil-shaped element, a pressure differential is created between the sides of each airfoil element 508 (the faster moving air is at a lower pressure). This causes additional air to be drawn over the leading edge 518 of each airfoil element 508, which has the following effects:

(1) it increases the total amount of airflow, hence acting as an airflow amplifier; and (2) it increases the density of air in the region of the leading edge and camber of each airfoil element 508.

Note that because of the increased density of the air from the leading edge back along the camber of each airfoil element 508, the acoustic impedance of the air in that region is increased (because the acoustic impedance is proportional to air density).

The efficiency of a system that is delivering power from one element to another is improved as the magnitude of the impedance of the two elements becomes closer together. Since mechanical air drivers such as baffles, cones, diaphragms are made of harder materials than air, their acoustic impedance is significantly larger than that of air. Typically, this causes a relatively large acoustic mismatch between a cone, baffle or diaphragm and the surrounding air, which leads to poor efficiency.

However, because of the increased acoustic impedance of the air at the leading edge of each movable airfoil element 508 (due to the higher air density), the efficiency of energy transfer from the motion of airfoil elements 508 to the surrounding air is improved. The inefficiency of this energy transfer process is a predominant factor that contributes to the inefficiency of a typical speaker system. The improvement in this energy transfer process that can be obtained by using embodiments of the invention significantly improves the efficiency of the overall system, thereby reducing power consumption.

As described, movable airfoil elements 508 are capable of rotation under influence of rotary voice coil 510, with that motion countered by torsion spring 512, so as to enable the angle of attack of airfoil elements 508 to the air flowing over those elements to be altered in response to an input signal (not shown) applied to coil 510. The input signal may be provided as the output of an amplifier, tuner, MP3 decoder or other suitable source. Note that the pressure generated by an airfoil varies approximately linearly with the angle of attack for angles of attack up to about 10 to 15 degrees, and that a symmetric airfoil is able to produce both negative and positive changes in pressure.

By rotating movable airfoil elements 508, the angle of attack of those elements relative to the airflow changes, and hence the pressure generated changes. By rotating the movable elements 508 proportionally to the desired audio signal, a desired acoustic wave can be generated. A combination of (1) the static airfoil's efficiency at driving a relatively large amount of air at a higher density and (2) the moveable airfoils acting as efficient air drivers within the region of higher density produces an efficient acoustic transducer which may be the basis for an earpiece, headphone, or loudspeaker. As noted, the static airfoil provides a number of benefits including that it acts to increase the velocity and volume of air flowing over the moveable airfoils. This means that the airflow generator (e.g., an air pump) may operate more slowly and with a lower air volume. This improves the efficiency of the overall system while also reducing the weight and cost of components, and may reduce any background noise associated with the pump. The static airfoil also acts to increase the density of air over the moveable airfoil element(s). This increase in air density improves the acoustic impedance and the efficiency of the moveable airfoil, and hence the overall system efficiency. This leads to reduced power consumption, smaller batteries, and lower cost components for a given degree of audio performance. The static airfoil also regulates and smoothes the airflow, leading to lower distortion (or equivalently, a better reproduction of the desired audio signal).

Static airfoil 502 shown in FIG. 5 may be extruded linearly, circularly or through an arc. Airfoil 502 is preferably at least partially hollow to allow air to flow inside the airfoil. As noted, one or more vents 506 are provided along airfoil 502 just behind the leading edge, on one side, through which air flowing within the airfoil may exit the airfoil. In a desirable design, air flowing out of vents 506 will smoothly follow the surface of airfoil 502 and will entrain surrounding air. In order to achieve this, vents 506 are preferably oriented facing back along airfoil 502, making an angle of approximately 30 degrees with the surface. The inner surfaces of vents 506 and any inner surfaces of airfoil 502 through which air flows should be relatively smooth, with few, if any, discontinuities or sharp edges.

Note that in typical operating conditions, the greater the velocity of air over static airfoil 502, the louder the achievable acoustic volume. Further, it is desirable that the pressure waves that represent the propagating sound not reduce the pressure over airfoil 502 to the point where it ceases to act as an airfoil. It is also desirable that the air velocity be achieved without introducing significant turbulence. To accomplish this, a vent shape that narrows towards the exit will act to accelerate the air smoothly via the Venturi effect. Also, providing an internal region of the static airfoil for airflow that is relatively large in cross-section will help to reduce turbulence.

While generating acoustic pressure waves, the pressure at and around air inlet 504 may change significantly. It is desirable that these pressure changes do not cause significant flexing or motion of airfoil 502, and particularly of the vents, or unacceptable vibrations may be introduced and the efficiency of the system may be reduced as energy is lost in deforming the airfoil material.

In order to increase the stiffness, while minimizing weight and achieving a smooth airflow, a strong, light weight material is preferable for the static airfoil. Metals such as steel and aluminum are suitable, as are plastics like ABS and polycarbonate. Painting, polishing, dipping and the like may be used to achieve a smoother surface.

Figure 6:
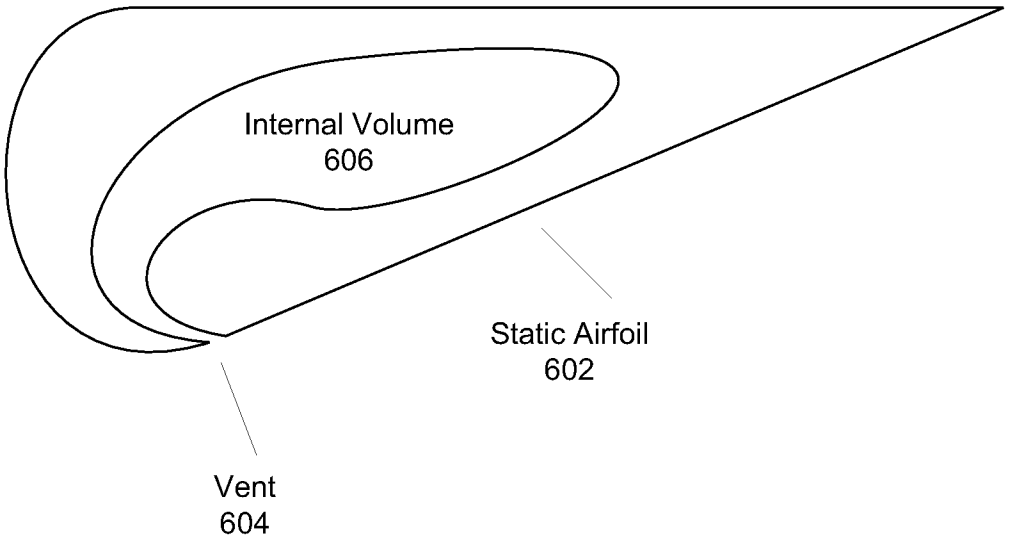
FIG. 6 is a diagram illustrating a cross-sectional view of the design of a static airfoil that may be used to implement an embodiment of the inventive acoustic transducer of FIG. 5.

To achieve the above-described goals of providing a high degree of stiffness and a relatively large internal volume that narrows rapidly to a vent, a cross-section for static airfoil 502 such as that shown in FIG. 6 may be used. FIG. 6 is a diagram illustrating a cross-sectional view of the design of a static airfoil 602 that may be used to implement an embodiment of the inventive acoustic transducer of FIG. 5. As shown in the figure, there are few (if any) sharp corners or edges, there is a significant body of material providing stiffness around the vent 604, the body narrows relatively quickly towards the vent, and there is a relatively large internal volume 606 for air to circulate in order to reduce turbulence.

As noted, a pump may be used to cause air to flow within airfoil 502 (or 602), with the air exiting through vents 506 (or 604). Preferably, the pump should provide a smooth, continuous airflow, and operate so as to not introduce significant turbulence or discontinuities in the airflow. In general, a positive displacement pump having a rotary mechanism is appropriate. This is because positive displacement pumps generally introduce less turbulence than impellors and fans, and rotary mechanisms are able to produce a more continuous flow than reciprocating mechanisms (such as pistons) which only produce airflow/pressure over a portion of their cycle. A rotary screw positive displacement pump is a suitable pump type for use in implementing the invention, as are rotary peristaltic pumps.

Note that it is important to minimize any constrictions to the airflow from the pump exit through to the vent(s). Thus it is best that the pump not have any downstream valves, has a relatively large mouth, and that pipes or connections leading to the airfoil should be no smaller than diameter of the inner section of the airfoil.

The capacity of an air pump that is desirable for operation can be estimated by considering the desired exit airflow velocity. The volume of air per second may be calculated as the vent exit velocity times the cross-section of the vent. For airflow at 25 m/s, with a vent 20 cm long and 1 mm wide, this will require a pump capable of generating an airflow of 0.005 cubic meters per second. The desired pressure capability can be determined from the desired air pressure outside the air vent times the cross section of the vent divided by the cross-section of airflow inside the static airfoil. While a relatively significant air volume is typically required for operation, the pressure differential across the pump is typically low, so a lightweight pump that can be operated at a high rate may be desired.

As air is flowing out of the vent(s) and along the static airfoil, it acts to entrain (i.e., capture and direct) further air over the leading edge and along the airfoil. This has a multiplier effect, and the total amount of air can be up to 15 times the mass of air exiting the vent. In typical operating conditions, the airflow along the static airfoil is approximately constant, perhaps speeding up slightly towards the back. The air velocity is lower at the surface (due to friction) and further away from the airfoil (as the velocity tends to become closer to that of the surrounding air). Typically, there is a region of fast moving air (which is also a region of higher density air) situated approximately 10% of the thickness of the static airfoil off the surface, and approximately 10% of the thickness of the static airfoil thick. This region is an effective location in which to place the movable airfoils as the air density is higher and leads to a better acoustic impedance match (in addition the air velocity is relatively high which improves the performance of the transducer). The movable airfoil(s) should preferably be placed far enough away from the static airfoil so that air pressure changes across the moveable airfoil element(s) are not impeded. This means the movable airfoil(s) should be placed approximately 1-2 times their own thickness away from the static airfoil. The thickness of the movable airfoil(s) should be sufficient to fill much of the remaining region of high velocity airflow.

In typical operation, the highest frequency that the movable airfoil(s) can produce is related to the length of the movable airfoil element and to the velocity of the air. To ensure a well reproduced sound wave, the time it takes for air to pass fully over the movable airfoil should be small compared to the period of the highest frequency being reproduced—otherwise different parts of the airfoil may attempt to provide different pressures, with possibly both rarefaction and compression being required simultaneously.

A useful rule in this regard is that the time it takes for air to flow over the chord of the movable airfoil(s) should be no more than 5% of the period of the highest frequency. For a 1 kHz capable transducer, with airflow of 100 m/s, this means a movable airfoil should be no longer than 5 mm. Since airfoil thicknesses should generally be no larger than 10-20% of the length, this provides for an airfoil thickness of 0.5 to 1 mm. Similarly, for an airflow of 25 m/s, the length should be no longer than 1.25 mm, with the thickness being no greater than 0.25 mm.

For a woofer speaker, with a maximum frequency of 150 Hz, at an air velocity of 25 m/s, the moveable airfoil(s) should be no longer than about 8 mm and no thicker than about 1 mm. The static airfoil should be approximately 10 times the chord length of the moveable airfoil. This ensures that changes in the air pressure near the moveable airfoil do not disrupt the bulk air flow generated by the static airfoil.

The extrusion length of the airfoils (both the static and the moveable) will have an effect on the volume of air affected, though the effect on volume of increasing the air flow velocity will generally be more significant. An extrusion length of approximately 5× the chord length is typically sufficient to ensure proper operation.

The moveable airfoils are responsible for generating significant air pressure above and below those elements. To ensure proper operation of the transducer, it is important that the airfoils not undergo a significant deformation as the pressure changes, as this results in a waste of energy. However, the airfoils may also be undergoing angular changes at a relatively high frequency, so to minimize energy consumption, these airfoils are preferably of relatively low mass. Thus, it is desirable to utilize a lightweight and relatively stiff construction or design for the movable airfoil(s) that is capable of meeting the desired length/thickness parameters. A strong, lightweight material such as aluminum or titanium may be used for this purpose. Further, it may be desirable that the airfoil have a hollow or honeycomb cross section designed to minimize bending.

To reduce bending, each movable airfoil may be supported along its length by passing through one or more bearings, which can be mounted on the main (static) airfoil. Preferably, the cross-section of the bearing as seen by the airflow should be as small as possible (thereby suggesting thin mountings and bearings) and relatively smooth (e.g., having rounded edges). As described, to control the position of the movable airfoil(s), a rotary voice coil may be mounted at one end, itself mounted to the static airfoil. Preferably, each moveable airfoil will be capable of rotation around its center of mass, to reduce its moment of inertia and hence the energy required to drive it.

Embodiments of the inventive acoustic transducer provide important benefits when compared to traditional acoustic transducers and speaker systems. One benefit compared to traditional loudspeakers is improved efficiency. As discussed, most traditional loudspeakers have a low efficiency due to the poor acoustic impedance match between the speaker cone or diaphragm and the surrounding air. In contrast, in some embodiments of the invention there is a substantially improved acoustic impedance match due to the higher density of air caused by the static airfoil and the airfoil-shaped design of the air driver (e.g., the moveable airfoil elements). Even in the absence of the static airfoil as a source of airflow over the movable airfoil-shaped elements, use of an airfoil-shaped element provides a more efficient conversion of mechanical to acoustic energy than do conventional diaphragms. For example, standard loudspeakers have a typical efficiency of between 5 and 10%, whereas an airfoil may have an efficiency of between 90 and 95% when converting mechanical energy into air pressure. Further, the embodiment of the invention shown in FIG. 5 is expected to provide greater power efficiency, suffer less from distortion, and operate over a wider range of frequencies than transducers that function based on other principles.

The improved conversion efficiency that can be obtained from embodiments of the invention may provide a number of advantages:

(1) for battery powered loudspeakers or other speakers where energy consumption is an important operating factor, embodiments of the invention use less energy and hence last longer on a given battery (or reduce the cost of the energy provided), and may allow use of lower-power power generation elements;

(2) smaller batteries may allow smaller devices, and the embodiments of the invention may typically be smaller for a given sound volume (because they more efficiently move air to generate sound waves) so the speakers may be smaller and more compact, which is desirable for portable speakers; and (3) the reduced size and power consumption typically act to reduce the cost of the speakers and associated components, require less powerful (and hence less expensive components), less physical material, less powerful and hence less expensive electronics, etc.

Yet another advantage of the inventive acoustic transducer shown in FIG. 5 is an improved frequency response and relatively better impulse response, because a less massive driver (such as the described rotary voice coil) can be used. This is because the driver is more efficient and is not wholly responsible for generating the operating air pressure (because the static airfoil acts as a passive airflow amplifier, the driver needs to move less air to generate the same overall air pressure).

While certain exemplary embodiments have been described in detail and shown in the accompanying drawings, it is to be understood that such embodiments are merely illustrative of and are not intended to be restrictive of the broad invention. Further, this invention is not to be limited to the specific arrangements and constructions shown and described, since various other modifications may occur to those with ordinary skill in the art.

As used herein, the use of "a", "an" or "the" is intended to mean "at least one", unless specifically indicated to the contrary.

What is claimed is:

1. A transducer operative to generate an output acoustic wave, comprising:

a source of airflow having an outlet;

a plurality airfoil-shaped elements that are in line with one another, are spaced apart in fixed relation to one another, and connected in common with a bearing, the plurality of airfoil-shaped elements are movably positioned relative to the outlet so that air exiting the outlet flows predominantly along an upper camber surface of each airfoil-shaped element; and a driver operative to rotate all of the plurality of airfoil-shaped elements in response to an input signal, thereby causing an angle of attack between a leading edge of all of the plurality of airfoil-shaped elements and the air exiting the outlet to vary in response to the input signal.

2. The transducer of claim 1, wherein the source of airflow further comprises:

a structure having a shape that is substantially that of an airfoil, wherein all of the plurality of airfoil shaped elements rotate relative to the static structure in response to the input signal;

an air inlet through which air may be supplied to an interior chamber of the static structure; and one or more vents, the vents providing an exit for air that is provided through the air inlet into the interior chamber of the structure, and the source of airflow comprises the air from the exit.

3. The transducer of claim 2, wherein each airfoil-shaped element, the static structure, or both includes and extrusion length that is approximately five times its chord length.

4. The transducer of claim 1, wherein the driver is a rotary voice coil.

5. The transducer of claim 1, further comprising an element operative to provide a bias force in response to a rotation caused by the driver.

6. The transducer of claim 1, wherein the input signal is the output of an amplifier, the output of a tuner, or the output of a MP3 decoder.

7. The transducer of claim 1 and further comprising: a spacer positioned between each of the plurality of airfoil-shaped elements.

8. The transducer of claim 1, wherein each airfoil-shaped element has a thickness that is approximately 15% 20% of its chord length.

9. The transducer of claim 1, wherein each airfoil-shaped element has a chord selected to provide a time for air to flow over the chord and the time is no more than approximately 5% of a period of a highest frequency of the transducer.

10. A system for producing an acoustic wave, comprising:

a source for an input signal;

a source of airflow having an outlet;

an airfoil-shaped element movably positioned relative to the outlet so that air exiting the outlet flows predominantly along an upper camber surface of the airfoil-shaped element;

a driver operative to rotate the airfoil-shaped element in response to the input signal, thereby causing an angle of attack between a leading edge of the airfoil-shaped element and the air exiting the outlet to vary in response to the input signal;

a static structure having a shape that is substantially that of an airfoil, wherein the airfoil shaped element rotates relative to the static structure in response to the input signal;

an air inlet through which air may be supplied to an interior chamber of the static structure; and one or more vents, the vents providing an exit for air that is provided through the air inlet into the interior chamber of the structure, and the source of airflow comprises the air from the exit.

11. The system of claim 10, wherein the source of the input signal is an amplifier, a tuner, or a MP3 decoder.

12. The system of claim 10, wherein the driver is a rotary voice coil.

13. The system of claim 10, further comprising an element operative to provide a bias force in response to a rotation caused by the driver.

14. The system of claim 13, wherein the element operative to provide a bias force is a torsion spring.

15. A transducer operative to generate an output acoustic wave, comprising:

a driver;

an armature element coupled to the driver, the armature undergoing motion in response to the input signal being input to the driver; and a plurality of airfoil-shaped elements coupled to the armature element and operative to move in response to the motion of the armature element, wherein the plurality of airfoil-shaped elements are coupled to the armature element in a manner so as to generate a longitudinal sound wave as the armature element undergoes motion, and wherein leading edges of the plurality of airfoil-shaped elements are positioned in opposing relation to each other and trailing edges of the plurality of airfoil-shaped elements are positioned in facing relation to each other.

16. The transducer of claim 15, wherein the driver is a solenoid.

17. The transducer of claim 15, wherein the motion comprises lateral motion and the armature is caused to move laterally in response to the input signal being input to the driver.

18. The transducer of claim 15, wherein the motion comprises rotational motion and the armature is caused to rotate in response to the input signal being input to the driver.

19. The transducer of claim 15, further comprising a source of the input signal.

20. The transducer of claim 19, wherein the source of the input signal is an amplifier, a tuner, or a MP3 decoder.

* * * * *